US009022047B2

(12) United States Patent
Cantrell et al.

(10) Patent No.: US 9,022,047 B2
(45) Date of Patent: May 5, 2015

(54) ROTISSERIE SKEWER, BASKET AND PARTS CLEANING ASSEMBLY

(75) Inventors: John Cantrell, Leawood, KS (US); Mark Churchill, Grain Valley, MO (US); Michael P. Licata, Lee's Summit, MO (US); David Gast, Lenexa, KS (US)

(73) Assignee: Unified Brands, Inc., Jackson, MS (US)

( * ) Notice: Subject to any disclaimer, the term of this patent is extended or adjusted under 35 U.S.C. 154(b) by 953 days.

(21) Appl. No.: 12/020,223

(22) Filed: Jan. 25, 2008

(65) Prior Publication Data

US 2008/0230091 A1 Sep. 25, 2008

Related U.S. Application Data

(60) Provisional application No. 60/886,870, filed on Jan. 26, 2007.

(51) Int. Cl.

| | |
|---|---|
| ***B08B 3/02*** | (2006.01) |
| ***B08B 3/04*** | (2006.01) |
| ***B08B 3/10*** | (2006.01) |
| *A47L 15/00* | (2006.01) |

(52) U.S. Cl.

CPC . *B08B 3/04* (2013.01); *A47L 15/00* (2013.01); *B08B 3/02* (2013.01); *B08B 3/10* (2013.01)

(58) Field of Classification Search

CPC ..... B08B 3/02; B08B 3/04; B08B 3/10
USPC ..... 134/198, 135, 138, 157–159
See application file for complete search history.

(56) References Cited

U.S. PATENT DOCUMENTS

| | | | | | |
|---|---|---|---|---|---|
| 1,826,015 | A * | 10/1931 | Morton | 134/111 |
| 1,961,548 | A * | 6/1934 | Caise | 68/184 |
| 2,054,366 | A * | 9/1936 | Drake | 134/170 |
| 3,739,791 | A * | 6/1973 | Fry et al. | 134/157 |
| 3,971,394 | A * | 7/1976 | Osborne | 134/104.4 |
| 4,294,272 | A * | 10/1981 | Klaiber | 134/138 |
| 4,353,381 | A * | 10/1982 | Winters | 134/111 |
| 4,527,843 | A | 7/1985 | Murdoch | |
| 4,773,436 | A | 9/1988 | Cantrell et al. | |
| 5,101,956 | A * | 4/1992 | Gambetti | 198/418.4 |
| 5,275,668 | A * | 1/1994 | Dell et al. | 134/10 |
| 6,113,452 | A * | 9/2000 | McGowan et al. | 446/26 |
| 6,739,348 | B2 | 5/2004 | Cantrell et al. | |
| 6,874,641 | B2 * | 4/2005 | Clary | 210/391 |
| 6,976,496 | B2 | 12/2005 | Cantrell et al. | |
| 6,984,161 | B2 | 1/2006 | Suzuki et al. | |
| 7,162,788 | B2 | 1/2007 | Inch et al. | |
| 7,246,624 | B2 | 7/2007 | Cantrell et al. | |
| 7,252,102 | B1 * | 8/2007 | Grass et al. | 134/184 |
| 2004/0244822 | A1 | 12/2004 | Cantrell et al. | |
| 2005/0056633 | A1 * | 3/2005 | Backus et al. | 219/392 |
| 2006/0005997 | A1 | 1/2006 | Kim et al. | |

* cited by examiner

*Primary Examiner* — Joseph L Perrin
*Assistant Examiner* — Kevin G Lee
(74) *Attorney, Agent, or Firm* — Kutak Rock LLP; Bryan P. Stanley

(57) ABSTRACT

A rotisserie skewer, basket and parts cleaning assembly is provided. The assembly is located within a wash tank that includes a jet nozzle to expel a stream of fluid into said wash tank. The assembly is rotatably mounted within the wash tank and is capable of holding parts for cleaning.

16 Claims, 6 Drawing Sheets

60
20
62
50
10

ROTISSERIE SKEWER, BASKET AND PARTS CLEANING ASSEMBLY

CROSS-REFERENCE TO RELATED APPLICATIONS

This application claims priority pursuant to 35 U.S.C. 119 (e) to U.S. Provisional Patent Application Ser. No. 60/886,870, filed Jan. 26, 2007, the entire disclosure of which is incorporated herein by reference.

FIELD OF THE INVENTION

The present invention relates generally to improvements in a pot and pan washing machine. More specifically, the present invention is concerned with a system and method for cleaning parts, such as skewers, baskets or other long parts, in a pot and pan washing machine and a cleaning assembly for cleaning parts within a wash tank of a pot and pan washing machine.

BACKGROUND OF THE INVENTION

Pot and pan washing machines, of the type used in restaurants, institutions and other facilities often involve a large wash tank or basin in which water is circulated about the pots and pans to provide a washing action. One such machine is described in U.S. Pat. No. 4,773,436 issued to Cantrell et al., the specification of which is incorporated herein by reference. The machine of Cantrell includes a wash tank with multiple jets spaced apart at an elevated position along a wall of the wash tank. The tank is filled with water to a level above the position of the jets. Pots and pans are placed in the wash tank, and a pump is activated to draw water from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

The inventions disclosed in U.S. Pat. Nos. 6,739,348; 6,976,496; 7,162,788; and 7,246,624, the entire disclosures of which are incorporated herein by reference, provide a number of improvements to machines such as disclosed in U.S. Pat. No. 4,773,436. Nevertheless, loading, unloading and cleaning of long parts such as skewers and baskets of motorized commercial rotisserie cookers (such as chicken rotisserie cookers used in restaurants and commercial kitchens) is often difficult due to the size and shape of those items. Therefore, it is desirable to provide a system and method of cleaning such items, that adequately cleans all surfaces of the items and that allows for easy loading and unloading of the items from the washing machine.

SUMMARY OF THE INVENTION

An object of the instant invention is to provide a system and method for cleaning parts, such as rotisserie skewers, baskets and/or other parts, in a washing machine. Another object of the invention is to provide an assembly for cleaning long parts, such as rotisserie skewers, baskets and/or other parts, in a washing machine. Another object of the invention is to provide a system and method of cleaning parts that allows for easy loading and unloading of the parts into a pot and pan washing machine tank. Another object of the invention is to provide a system and method of cleaning parts where the wash tank may additionally be used for scrapping, pre-rinsing, and/or final rinsing, thereby reducing the overall footprint of the machine by eliminating the need for separate scrapping and/or rinsing basins or areas. Another object of the invention is to provide a system for cleaning parts that reduces the upward splashing of cleaning fluid and/or reduces the risk of injury to bystanders and nearby objects caused by moving parts of the system.

The above objects of the instant invention are accomplished through a rotating assembly that is located within a wash tank of a pot and pan washing machine. In a preferred embodiment, the wash tank is the wash tank portion of a pot and pan washing machine similar to that described in any of U.S. Pat. Nos. 4,773,436; 6,739,348; 6,976,496; 7,162,788; or 7,246,624. Nevertheless, it will be appreciated that other wash tanks and washing machines, or various combinations of wash tank components, could be utilized without departing from the spirit and scope of the instant invention.

The present invention comprises a system and method for cleaning parts in a washing machine and a cleaning assembly for cleaning parts within a wash tank of a washing machine. The system comprises a wash tank, at least one jet nozzle, and a cleaning assembly. The wash tank includes a bottom wall, a rear wall, a front wall and two side walls extending generally upwardly from the bottom wall. The jet nozzle(s) expel a stream of fluid into the wash tank. The cleaning assembly is rotatably mounted within the wash tank. The cleaning assembly is capable of holding parts, such as skewers, baskets and/or other parts, for cleaning. At least a portion of the cleaning assembly is located within the stream of fluid expelled by the jet nozzle(s). In a preferred embodiment, the jet nozzle(s) are located along the rear wall of the wash tank. In another preferred embodiment, the cleaning assembly is situated such that it passively rotates due to the stream of fluid expelled by the jet nozzle(s). In another preferred embodiment, the cleaning assembly is attached to the inside of the wash tank such that, when the wash tank is filled with cleaning solution, the cleaning assembly is partially submerged. In still another preferred embodiment, the cleaning assembly of the instant invention further includes a lid covering at least a portion of the cleaning assembly. In preferred embodiments, the system includes a safety switch to stop the operation of the system when the lid is in any position other than the closed position.

In a preferred embodiment of the instant invention, the system also includes a scrapping/rinsing rack. The rack is located along the front wall of the wash tank and, in a preferred embodiment includes a plurality of holes to allow fluid to flow into the rack from the tank and drain out of the rack into the tank. In preferred embodiments, the rack includes a plurality of support structures sized and shaped to receive skewers, baskets and/or other parts. In another preferred embodiment, the rack is removable from the system.

The method for cleaning parts in a washing machine comprises inserting a part into a cleaning assembly, locating the cleaning assembly in a wash tank containing a cleaning fluid, directing a stream of cleaning fluid at the cleaning assembly, and rotating the cleaning assembly. The rotation of the cleaning assembly in a preferred embodiment of the method is accomplished passively by the force exerted upon the cleaning assembly by the stream of fluid directed at the cleaning assembly. In an alternative embodiment, the rotation of the cleaning assembly is accomplished by a motor or other suitable power mechanism attached to the cleaning assembly.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of the invention may be employed without reference to other features and subcombinations. Other objects and advantages of this invention will become apparent from the following description taken in connection with the accompanying drawings, wherein it is set forth by way of illustration and example, an embodiment of this invention and various features thereof.

BRIEF DESCRIPTION OF THE DRAWINGS

Preferred embodiments of the invention, illustrative of the best modes in which the applicant has contemplated applying the principles, are set forth in the following description and is shown in the drawings and is particularly and distinctly pointed out and set forth in the appended claims.

DETAILED DESCRIPTION OF A PREFERRED EMBODIMENT

As required, several detailed embodiments of the present invention are disclosed herein; however, it is to be understood that the disclosed embodiments are merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
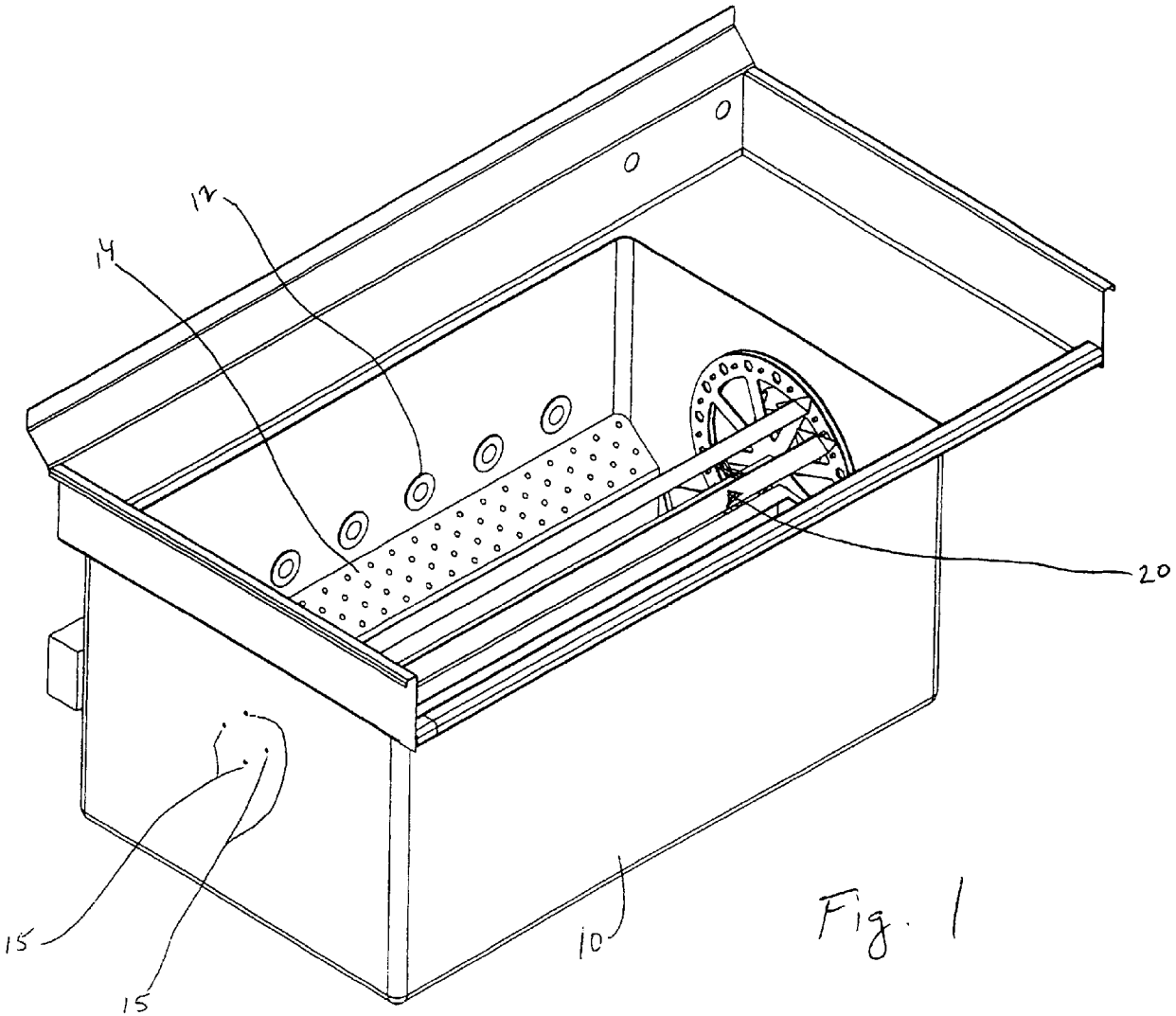
FIG. 1 shows a perspective view of a system of the instant invention including a wash tank, jet nozzles and parts cleaning assembly.
Figure 5:
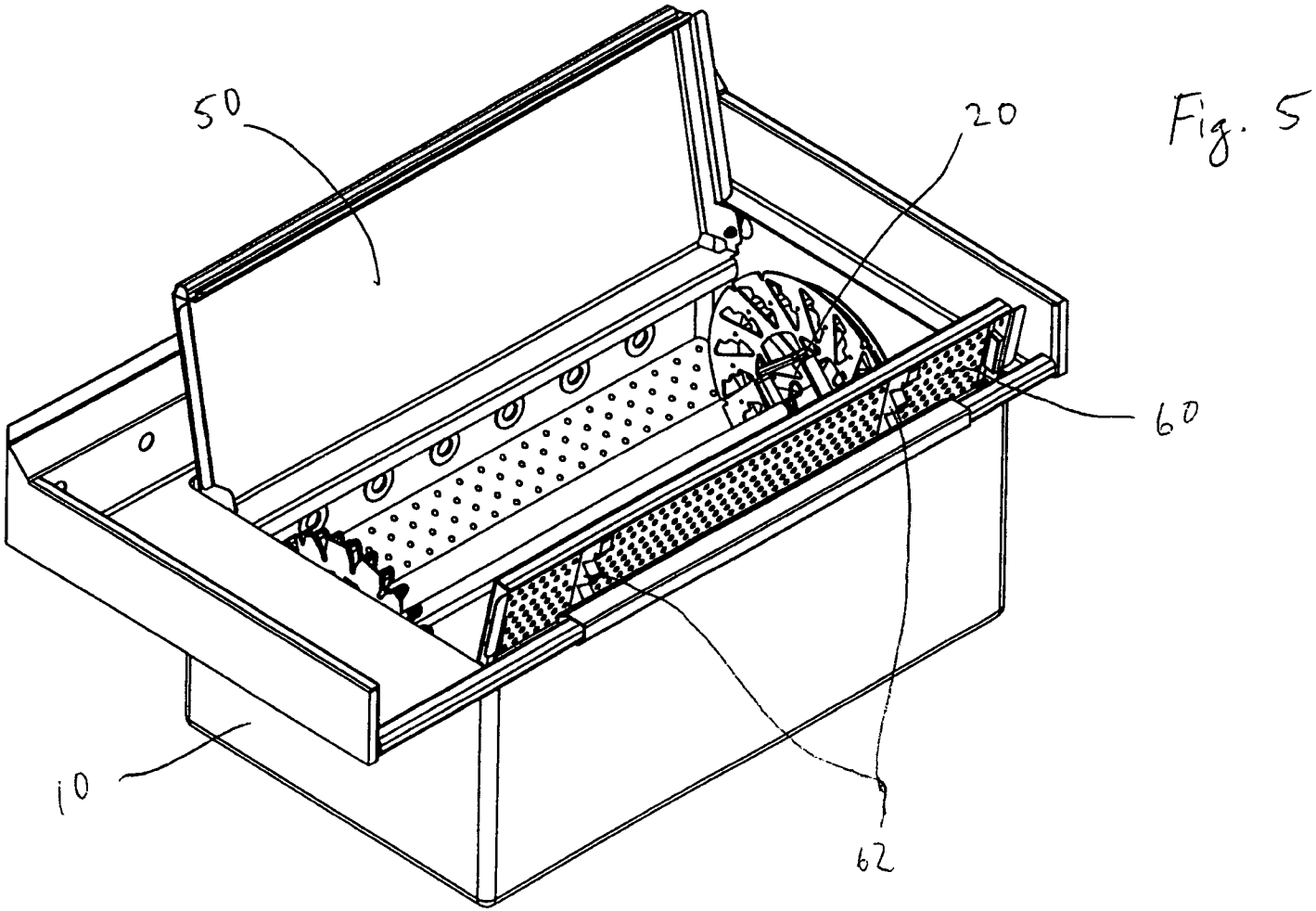
FIG. 5 shows perspective view of another system of the instant invention including a lid and a scrap/rinse rack in an open position.
Figure 6:
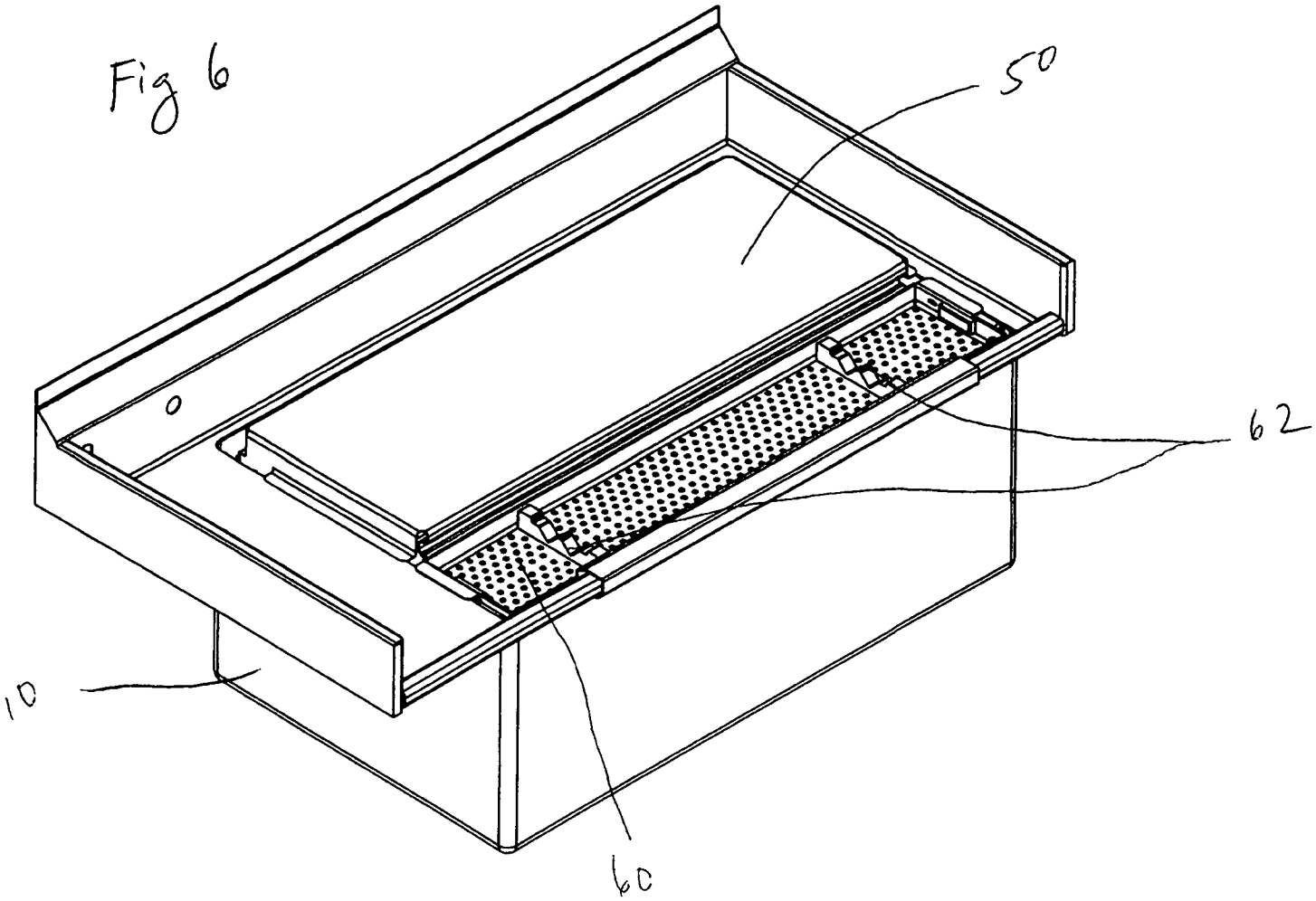
FIG. 6 shows a perspective view of the system of FIG. 5 including a lid and a scrap/rinse rack in a closed position.

Referring to FIG. 1, a system of the instant invention is shown. The system comprises a wash tank 10, jet nozzles 12, intake assembly 14, and a cleaning assembly 20. The wash tank 10 includes a bottom wall, a rear wall, a front wall and two side walls extending upwardly from the bottom wall. The jet nozzles 12 expel a stream of fluid into the wash tank 10. The cleaning assembly 20 is rotatably mounted within the wash tank 10. The cleaning assembly 20 is capable of holding parts for cleaning, such as baskets 30 and/or skewers 40, as shown in FIGS. 5-6. At least a portion of the cleaning assembly 20 is located within the stream of fluid expelled by the jet nozzles 12. In the embodiment shown in FIG. 1, the jet nozzles 12 are located along the rear wall of the wash tank 10. The cleaning assembly 20 is situated such that it passively rotates due to the stream of fluid expelled by the jet nozzles 12. The cleaning assembly 20 is attached to the inside of the wash tank 10 such that, when the wash tank 10 is filled with cleaning solution, the cleaning assembly 20 is partially submerged.

Referring to FIGS. 5 and 6, additional embodiments of the instant invention are shown. The system of such embodiments further includes a lid 50 covering at least a portion of the wash tank 10. In the embodiment shown in FIGS. 5 and 6, lid 50 covers cleaning assembly 20. In a preferred embodiment, the system includes a safety switch (not shown) to stop the operation of the system when the lid 50 is in any position other than the closed position. The system of FIG. 5 shows the lid 50 in an open position. The system of FIG. 6 shows the lid 50 in a closed position.

The system shown in FIGS. 5 and 6 also includes a scrap/rinse rack 60. The rack 60 is located along the front wall of the wash tank 10 and includes a plurality of holes to allow fluid to flow into the rack 60 from the tank and drain out of the rack 60 into the tank. It will be appreciated that alternative structures for the rack may be utilized without departing from the spirit and scope of the instant invention. For example, in an alternative embodiment, the scrap/rinse rack is constructed of an open framework (as opposed to the plurality of holes through a bottom wall) to allow fluid to flow into and out of the rack. In preferred embodiments, rack 60 also includes a plurality of support structures 62 sized and shaped to receive skewers, baskets and other parts. The support structures 62 provide stability/support for holding the various parts during scrapping and/or rinsing of those parts. In a preferred embodiment, the rack 60 is removable from the system. The system of FIG. 5 shows both the rack 60 and lid 50 in an open position. The system of FIG. 6 shows both the rack 60 and lid 50 in a closed position. In the embodiment shown in FIGS. 5 and 6, lid 50 and rack 60 are rotatably mounted to the inside of wash tank 10 via bearings similar to bearings 26 and 26' discussed in further detail below. Nevertheless, it will be appreciated that alternative mounting structures for lid 50 and rack 60 may be utilized without departing from the spirit and scope of the instant invention.

Figure 2:
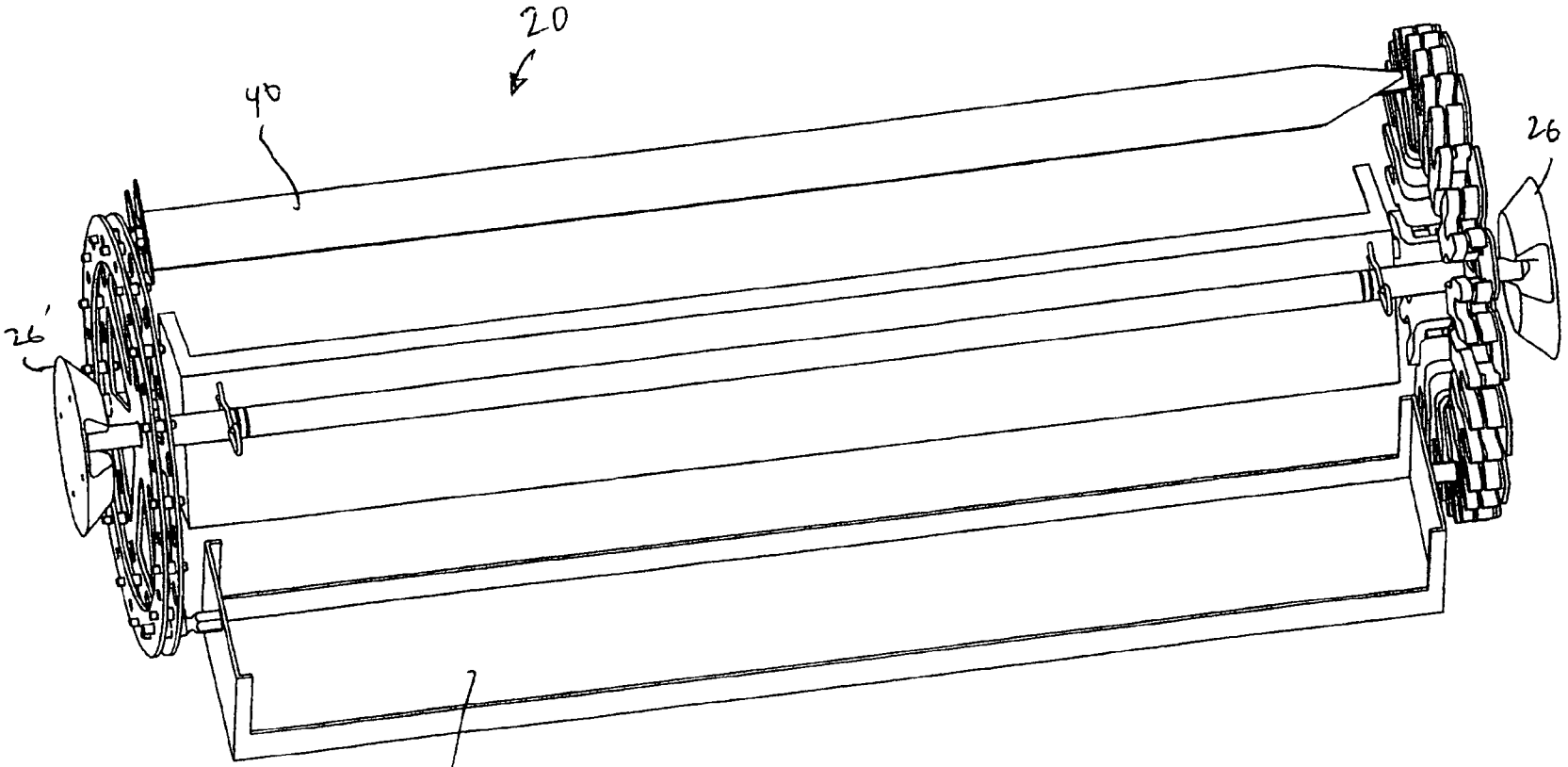
FIG. 2 shows a detailed perspective view of the parts cleaning assembly of FIG. 1.
Figure 4:
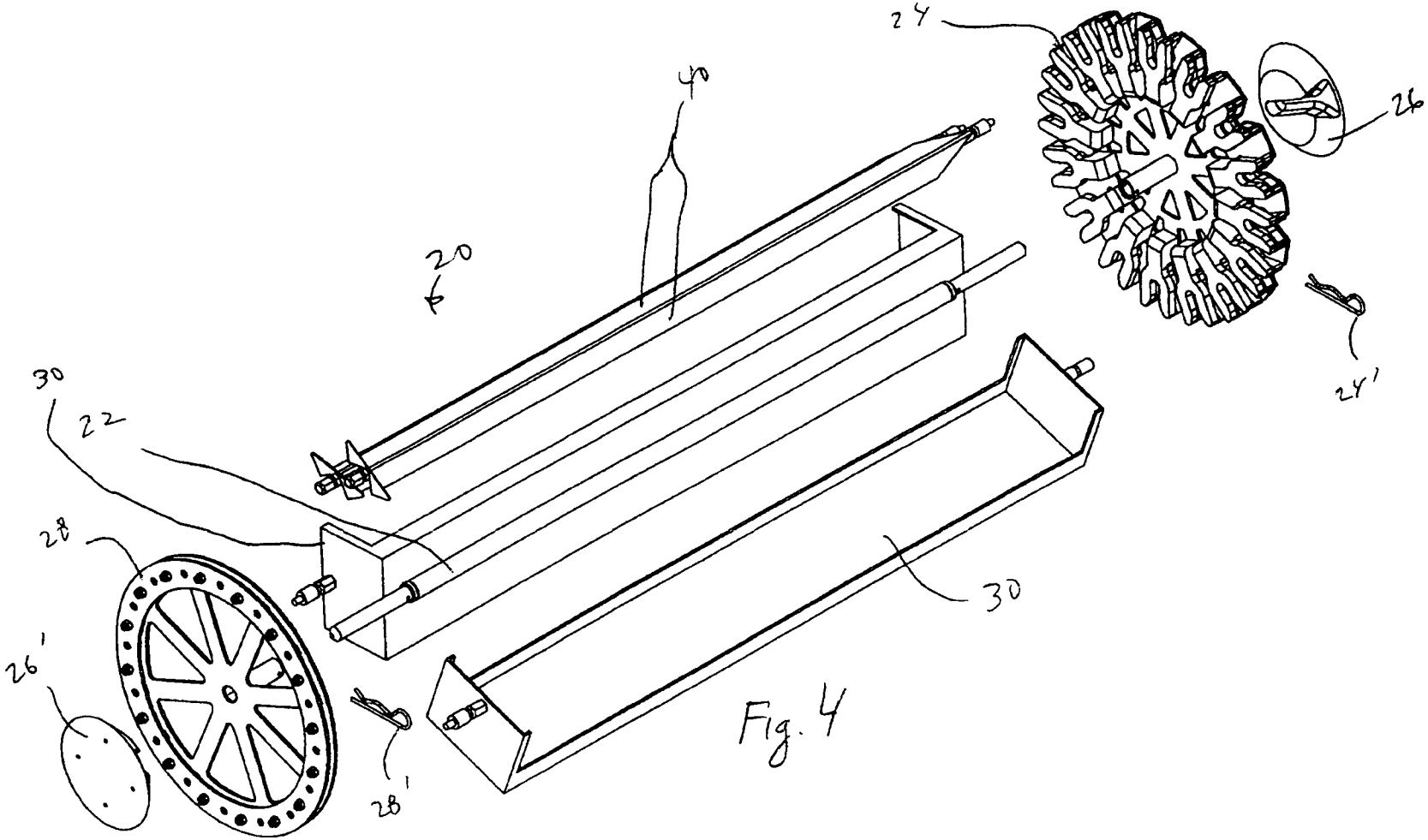
FIG. 4 shows an exploded perspective view of the parts cleaning assembly of FIG. 1.

Referring to FIGS. 2 and 4, the cleaning assembly 20 is shown in more detail. The cleaning assembly comprises a central shaft 22, a retainer wheel assembly 24, and a slip wheel assembly 28. The retainer wheel assembly 24 is connected to one end of the central shaft 22 and the slip wheel assembly 28 is connected to the other end of the central shaft 22. In a preferred embodiment, the slip wheel assembly 28 comprises at least one ring with a plurality of holes. Each of the holes are aligned in parallel to the long axis of the central shaft 22.

In one embodiment, the retainer wheel assembly 24 and the slip wheel assembly 28 are fixedly connected to their respective ends of the central shaft 22. Either one of the retainer wheel assembly 24 or the slip wheel assembly 28 is, preferably both are, fixedly connected to its respective end of the central shaft 22 by aligning a hole in the retainer wheel assembly 24 or the slip wheel assembly 28, preferably both, with a hole in the respective end of the central shaft 22 and inserting a cotter pin or hitch pin, 24' and 28' respectively, through the aligned holes as shown in FIG. 4. The central shaft 22 extends through the center of the retainer wheel assembly 24 to a first bearing 26 and, in the opposite direction, through the center of the slip wheel assembly 28 to a second bearing 26'. One, preferably both, of these two bearings, 26 and 26', is further comprised of a groove for receiving the central shaft 22 such that the central shaft 22 is capable of rotating passively about its long axis, while the cleaning assembly 20 is capable of being separated from the bearings 26 and 26' by sliding the ends of the central shaft 22 along the respective grooves of the bearings 26 and 26'. The grooves are comprised of concave surfaces such that they are self-draining of fluid. Once retainer wheel assembly 24 and slip wheel assembly 28 are attached to shaft 22 with the cotter pin or hitch pin as described above, the assembly is placed within grooves of bearings 26 and 26'. Bearings 26 and 26' are attached to wash tank 10 using sealing bolts (such as for example hex bolts with an o-ring) that extend through holes 15 in wash tank 10. It will be appreciated that alternative structures and arrangements of retainer wheel assembly 24 and slip wheel assembly 28 may be utilized without departing from the spirit and scope of the instant invention. For example, in one alternative embodiment, retainer wheel assembly 24 and slip wheel assembly 28 are each mounted to opposing end/side walls of wash tank 10 without the inclusion of central shaft 22, such that retainer wheel assembly 24 and slip wheel assembly 28 each rotate independently of one another.

In the embodiment shown in FIGS. 2 and 4, the slip wheel assembly 28 is comprised of two rings that are fixedly connected together. One ring is comprised of a plurality of hexagonal-shaped holes. The second ring is comprised of a plurality of round-shaped holes. At least one of the hexagonal-shaped holes of the first ring is aligned with at least one of the round-shaped holes of the second ring. Preferably, each of the hexagonal-shaped holes of the first ring is aligned with a corresponding round-shaped hole of the second ring. In the embodiment shown in FIGS. 2 and 4, the two rings of the slip wheel assembly 28 are connected together by a plurality of nuts and bolts. It will be appreciated that alternative methods of connecting the two rings together may be utilized (such as welding) without departing from the spirit and scope of the instant invention. Furthermore, it will be appreciated that alternative hole shapes, arrangements and patterns may be utilized, as well as other suitable structures for slip wheel assembly 28, depending upon the particular parts to be received and held, without departing from the spirit and scope of the instant invention.

Figure 3:
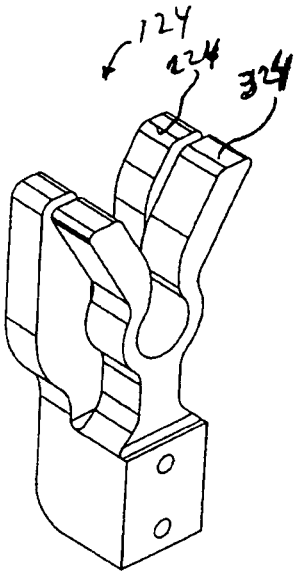
FIG. 3 shows a detailed perspective view of a retainer assembly that is mounted to the retainer wheel assembly portion of the parts cleaning assembly of FIG. 1.

In the embodiment shown in FIGS. 2 and 4, the retainer wheel assembly 24 is comprised of a plurality of retainer assemblies 124 (a detailed perspective view of the retainer assembly 124 is shown in FIG. 3). Each retainer assembly 124 is mounted to a mounting plate of the retainer wheel assembly 24. Each retainer assembly 124 is comprised of a rigid member 224 and a generally flexible member 324. Preferably, the retainer assembly 124 is made of a glass-filled nylon material. Preferably, the rigid member 224 and a generally flexible member 324 are generally Y-shaped. It will be appreciated that numerous alternative materials for retainer assembly 124, as well as alternative shapes and configurations of retainer assembly 124 may be utilized without departing from the spirit and scope of the instant invention.

In operation, parts that need to be cleaned, such as baskets 30 and/or skewers 40, are placed into assembly 20 by placing the rear end of the part, which typically includes a pin or hex end into receiving holes of slip wheel assembly 28. As is discussed above, in a preferred embodiment slip wheel assembly 28 includes hex holes through a first ring, and round holes through a second ring, so as to accommodate a wide variety of end geometries (including but not limited to round pins, hex pins and hex pins with round end tips). The opposing end of each basket 30 or skewer 40 (which typically include a round/cylindrical pin and a retention groove) is placed into one of numerous retainer assemblies 124 which are mounted to the retainer wheel assembly 24. Each retainer assembly 124 includes a rigid member 224 and a generally flexible member 324. The rigid member 224 receives the end of the basket 30, skewer 40, or other part as it is being positioned downward into retainer assembly 124 and forces the end into a safe downward position as it is placed within flexible member 324. This protects flexible member 324 from undue fatigue and damage. As previously described, in a preferred embodiment, retainer assembly 124 is made of a glass-filled nylon or other suitable material; nevertheless it will be appreciated that alternative materials may be utilized without departing from the spirit and scope of the instant invention.

In a preferred embodiment, assembly 20 will be constructed and positioned in wash tank 10 such that when wash tank 10 is filled with soap and water for operation, the top of assembly 20 will be above the water line. This allows operators to load and unload parts such as baskets 30, skewers 40, and/or other parts above, or partially above, the water line, thereby permitting the operators to easily see what they are doing and safely load and unload parts from the machine. Shaft 22 freely rotates with the grooves of bearings 26 and 26' to allow operators to easily rotate assembly 20 for loading and unloading. Furthermore, the water line will be above the top of jets 12. This allows assembly 20 to passively rotate when the washing machine is in operation as the jet-stream created by jets 12 against baskets 30, skewers 40, and/or other parts will create a rotational force. The rotation of assembly 20 results in exposure of all surfaces of baskets 30, skewers 40, and/or other parts to the cleaning action of the washing machine. With a lid in a closed position, the instant invention reduces the upward splashing of cleaning fluid and reduces the risk of injury to bystanders and nearby objects caused by moving parts of the system. Equipped with a rack that is removable or capable of being in a closed or open position, the system may additionally be used for scrap, pre-rinse, and final rinse, thereby reducing the overall footprint of the machine by eliminating the need for separate scrap and rinse basins. Although in the embodiment discussed above the rotation of assembly 20 is caused passively by the jet-stream created against baskets 30, skewers 40, and/or other parts positioned within assembly 20, it will be appreciated that assembly 20 may also include suitable structure for receiving the force exerted by the jet-stream. In one embodiment assembly 20 includes cross-members connecting the outer perimeter of retainer wheel assembly 24 to the outer perimeter of the slip wheel assembly 28, such that the jet-stream exerts of force on the cross members. In another embodiment, the cross member is a basket for holding parts to be cleaned.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A system for cleaning parts in a wash tank at least partially filled with a cleaning fluid comprising:

a wash tank including a bottom wall, a rear wall, a front wall and two side walls extending generally upwardly from said bottom wall;

at least one jet nozzle to expel a stream of fluid into said wash tank; and a wheel assembly rotatably mounted within said wash tank, a wheel of said assembly being capable of receiving and holding an end of a part for cleaning, wherein said wheel comprises a first ring with a plurality of specially-shaped insertion points and a second ring with a plurality of other specially-shaped insertion points, wherein during operation at least a portion of said assembly or said part held by said wheel of said assembly is located within the stream of fluid expelled by said jet nozzle;

wherein said wheel assembly comprises:

a retainer wheel assembly; and a second wheel assembly opposing said retainer wheel assembly; and wherein said second wheel assembly comprises the first ring with the plurality of specially-shaped insertion points, said specially-shaped insertion points being configured to mirror a shape of the part being received by said specially-shaped insertion points, and the second ring with the plurality of other specially-shaped insertion points, said other specially-shaped insertion points being round shaped.

2. The system of claim 1, wherein said jet nozzle is located along said rear wall.

3. The system of claim 1, wherein said assembly passively rotates due to the stream of fluid expelled by said jet nozzle.

4. The system of claim 1, wherein said assembly is attached to the inside of said wash tank such that, when said wash tank is filled with a cleaning solution, a portion of said assembly is not submerged.

5. The system of claim 1, further comprising a lid covering at least a portion of said wash tank.

6. The system of claim 5, wherein the lid has a closed position and the system further comprises a safety switch, wherein the safety switch stops the operation of the system when the lid is not in the closed position.

7. The system of claim 1 further comprising a first bearing connecting said retainer wheel assembly to a wall of said wash tank, and a second bearing connecting said second wheel assembly to a wall of said wash tank.

8. The system of claim 7 wherein at least one of the first and second bearings further comprises a groove for receiving a shaft of one of said retainer wheel assembly or said second wheel assembly.

9. The system of claim 1, wherein the retainer wheel assembly comprises a plurality of retainer assemblies.

10. The system of claim 9, wherein each retainer assembly comprises a rigid member and a generally flexible member.

11. The system of claim 1 wherein said wash tank is filled with a cleaning solution to a level at least above said jet nozzle.

12. The system of claim 1, further comprising:

a scrapping/rinsing rack extending substantially along a length of the front wall of the wash tank, wherein the rack further comprises a plurality of support structures sized and shaped to hold skewers, baskets and other parts above the scrapping/rinsing rack.

13. The system of claim 12, wherein the rack includes a plurality of insertion points or an open framework to allow fluid to flow from the tank into the rack and drain out of the rack into the tank.

14. The system of claim 12, wherein the rack is removable from the system.

15. The system of claim 8, wherein:

the groove for receiving a shaft of one of said retainer wheel assembly or said second wheel assembly is a radially extending groove.

16. The system of claim 1, wherein said specially-shaped insertion points are hexagonal shaped.

* * * * *